US005822885A

United States Patent [19]

Loverin

[11] Patent Number: 5,822,885

[45] Date of Patent: Oct. 20, 1998

[54] SHOE OUTSOLE ASSEMBLY

[75] Inventor: Marc R. Loverin, Arlington, Mass.

[73] Assignee: SRL, Inc., Wilmington, Del.

[21] Appl. No.: 797,109

[22] Filed: Feb. 10, 1997

[51] Int. Cl.[6] ..... A43B 13/00; A43B 23/00

[52] U.S. Cl. ..... 36/25 R; 36/112; 36/136

[58] Field of Search ..... 36/1, 25 R, 112, 36/136, 137

[56] References Cited

U.S. PATENT DOCUMENTS

| | | | |
|---|---|---|---|
| 2,759,284 | 8/1956 | Santisi | 36/136 |
| 2,889,639 | 6/1959 | Rudine | 36/25 R |
| 3,082,556 | 3/1963 | Schwartz et al. | 40/2 |
| 4,020,572 | 5/1977 | Chiaramonte, Jr. | 36/137 |
| 4,041,618 | 8/1977 | Famolare, Jr. | 36/25 R |
| 4,050,167 | 9/1977 | Senter | 36/32 |
| 4,112,601 | 9/1978 | Chiaramonte, Jr. | 36/137 |
| 4,347,673 | 9/1982 | Svetlik | 36/32 |
| 4,712,314 | 12/1987 | Sigoloff | 36/112 |
| 4,974,345 | 12/1990 | Yung-mao | 36/136 |
| 5,084,988 | 2/1992 | Berger | 36/112 |
| 5,231,776 | 8/1993 | Wagner | 36/1 |

FOREIGN PATENT DOCUMENTS

| | | | |
|---|---|---|---|
| 1144149 | 3/1969 | United Kingdom | 36/112 |

*Primary Examiner*—M. D. Patterson
*Attorney, Agent, or Firm*—Fish & Richardson P.C.

[57] ABSTRACT

The outsole assembly of a shoe having an upper defining a volume for enclosing a wearer's foot, with the outsole assembly attached generally therebelow, includes an outsole consisting of an outsole body of transparent material defining a water impervious outsole bottom surface disposed for engagement with a walking surface when worn, an outsole upper surface disposed generally in opposition to the volume, and an outsole side surface extending peripherally about the outsole generally between the outsole bottom and upper surfaces. A grid member defines at least one aperture at the outsole upper surface. An article disposed within the aperture is observable through the water impervious outsole bottom surface of the body of transparent material. A method for shoe assembly is also described.

16 Claims, 3 Drawing Sheets

SHOE OUTSOLE ASSEMBLY

BACKGROUND OF THE INVENTION

The invention relates to shoes.

For the purpose of attracting the attention and interest of children, it has been known to provide shoes including novelty or entertainment features. In some instances, these entertainment features have taken the form of compartments formed in the shoe, often with clear or transparent windows in order to permit the viewing of articles contained therewithin. For example, Sigoloff U.S. Pat. No. 4,712,314 describes a footwear sole having a bottom surface with an aperture containing a figure or text, covered by a transparent insert.

Purchasers of such shoes, typically parents of the intended wearers, are more often seeking value, with the objective that the shoes perform the intended purpose for a reasonable period of time. It is often a further objective that the incorporated entertainment or novelty feature continue to preform for a similar period of time.

SUMMARY OF THE INVENTION

According to one aspect of the invention, in a shoe comprising an upper defining a volume for enclosing a wearer's foot, and an outsole assembly attached generally below the upper, the outsole assembly comprises an outsole comprising of an outsole body of transparent material defining a water impervious outsole bottom surface disposed for engagement with a walking surface when worn, an outsole upper surface disposed generally in opposition to the volume, and an outsole side surface extending peripherally about the outsole generally between the outsole bottom and top surfaces, a grid member defining an aperture at the outsole upper surface, and an article disposed within the aperture, the article disposed in the aperture at the outsole upper surface being observable through the water-impervious, transparent outsole bottom surface of the outsole body.

Preferred embodiments of this aspect of the invention may include one or more of the following additional features. The grid member is integral with the outsole body, or it may have the form of a separate element disposed generally upon the outsole body in contact upon the outsole upper surface in the outsole assembly. The article disposed within the aperture comprises a three dimensional article, which may have the form, e.g., of an insect or a fossil. The outsole body has a tint resembling amber and the article resembles, e.g., an insect preserved therein. The outsole bottom surface defines a plurality of lugs, and the aperture defined at the outsole upper surface lies generally in register with the lug. The three dimensional article has article planar dimensions in an article plane generally parallel to a plane of the outsole upper surface, the article planar dimensions being selected relative to planar dimensions of the aperture in the article plane to facilitate movement along the article plane of the three dimensional article within the aperture. The three dimensional article has article thickness dimensions in a direction generally perpendicular to the article plane, the article thickness dimensions being selected relative to thickness dimensions of the aperture in a direction generally perpendicular to the article plane to restrict movement in a direction generally perpendicular to the article plane of the three dimensional article within the aperture. An aperture in a heel region of the outsole has a predetermined shape at the outsole upper surface, and the outsole assembly further comprises an insert element having a shape generally corresponding to the predetermined shape of the rear aperture and a predetermined insert thickness, the insert element being adapted to be received into the rear aperture containing a three dimensional article in a manner to restrict movement of the three dimensional article in the rear aperture in a direction perpendicular to the plane of the outsole upper surface.

According to another aspect of the invention, a method for assembly of footwear comprises the steps of providing a shoe upper defining a volume for receiving a wearer's foot, providing an outsole assembly comprising an outsole comprising an outsole body of transparent material defining a water impervious outsole bottom surface disposed for engagement with a walking surface when worn, an outsole upper surface disposed generally in opposition to the volume, and an outsole side surface extending peripherally about the outsole generally between the outsole bottom and top surfaces, and a grid member defining an aperture at the outsole upper surface, placing an article into the aperture, and assembling the outsole assembly with the upper to form a shoe having an article that may be observed through the water impervious bottom sole surface.

Preferred embodiments of this aspect of the invention may include one or more of the following additional features. The method comprises the further step of placing within the aperture a three dimensional article having a form resembling an insect. The method comprises the further step of placing within the aperture a three dimensional article having a form resembling a fossil. The method comprises the further steps of providing an outsole having a tint resembling amber, and placing within the aperture a three dimensional article having a form resembling an insect or fossil. The method comprises the further steps of providing an insert element having a shape generally corresponding to a predetermined shape of a rear aperture and a predetermined insert thickness, and, after placing an article into the aperture, inserting the insert element into the rear aperture.

Other features and advantages of the invention will be apparent from the following description of a presently preferred embodiment, and from the claims.

Shoe designs embodying my invention are also shown in my design patent applications filed simultaneously with this application (application Ser. No. 29/066,275, filed Feb. 10, 1997, entitled "SHOE"; application Ser. No. 29/066,272, filed Feb. 10, 1997, entitled "SHOE SOLE"; application Ser. No. 29/066,264, filed Feb. 10, 1997, entitled "ELEMENT FOR A SHOE UPPER"; and application Ser. No. 29/066, 263, filed Feb. 10, 1997, entitled "LEATHER FABRIC"), the disclosures of which are incorporated herein by reference.

DESCRIPTION OF THE PREFERRED EMBODIMENTS

Figure 1:
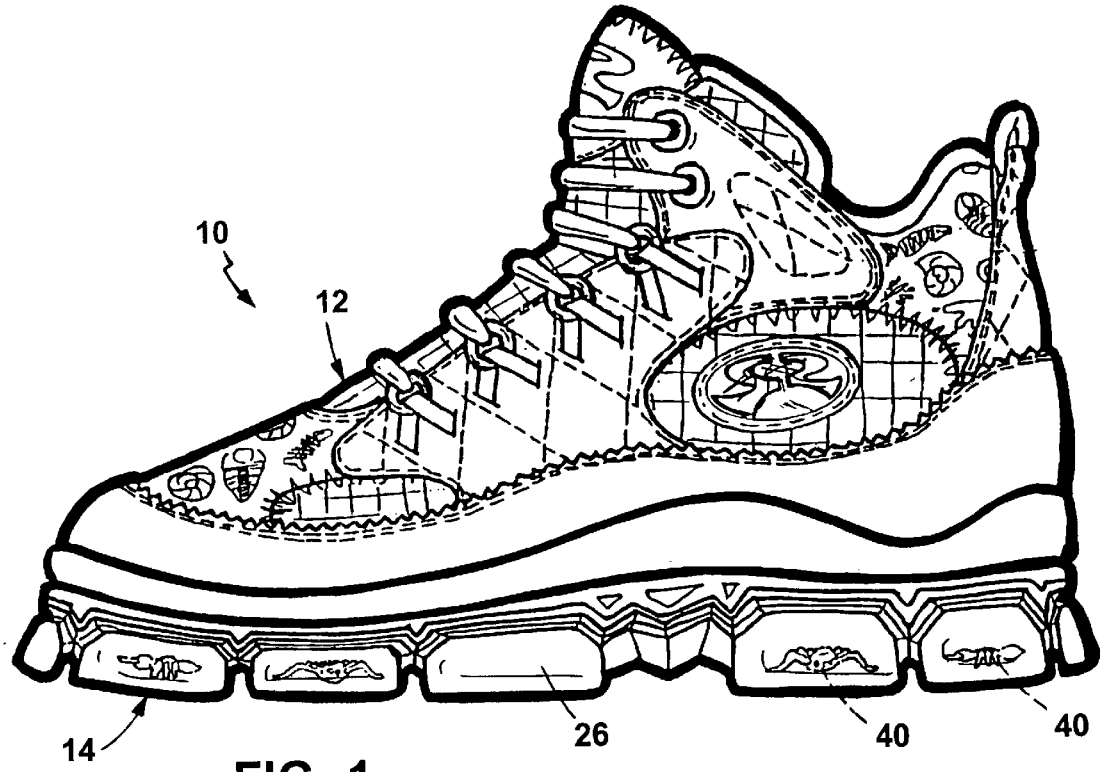
FIG. 1 is a side view of one embodiment of a (right) shoe with an outsole assembly of the invention.
Figure 7:
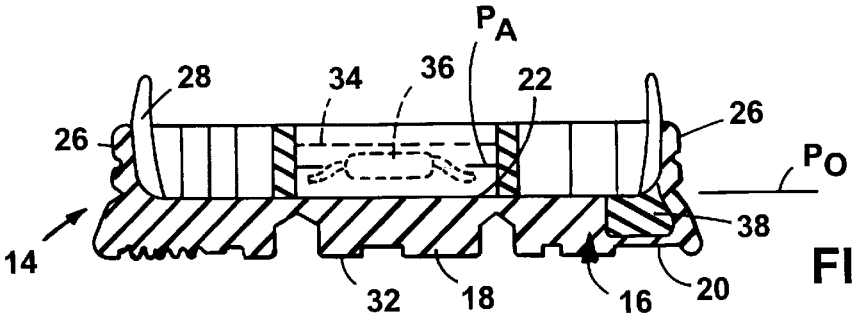
FIG. 7 is another end section view of the outsole assembly of the invention taken along the line 7—7 of FIG. 4, also with a novelty figure shown in dashed line.
Figure 6:
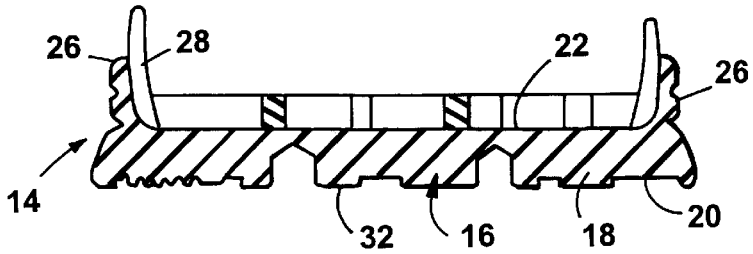
FIG. 6 is an end section view of the outsole assembly of the invention taken along the line 6—6 of FIG. 4, with a novelty figure shown in dashed line.
Figure 3:
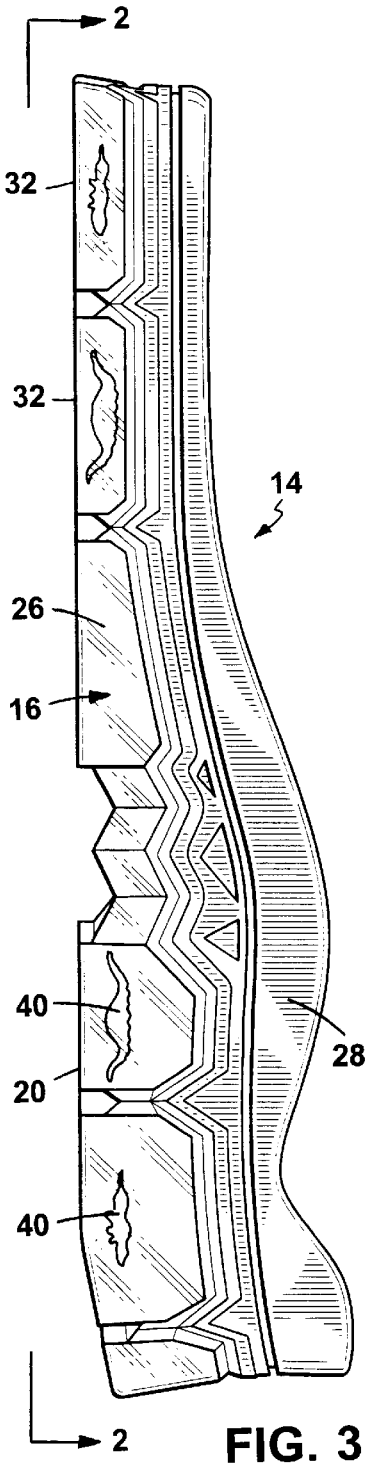
FIG. 3 is a side view of the outsole assembly of the shoe of the invention taken at the line 3—3 of FIG. 2.
Figure 2:
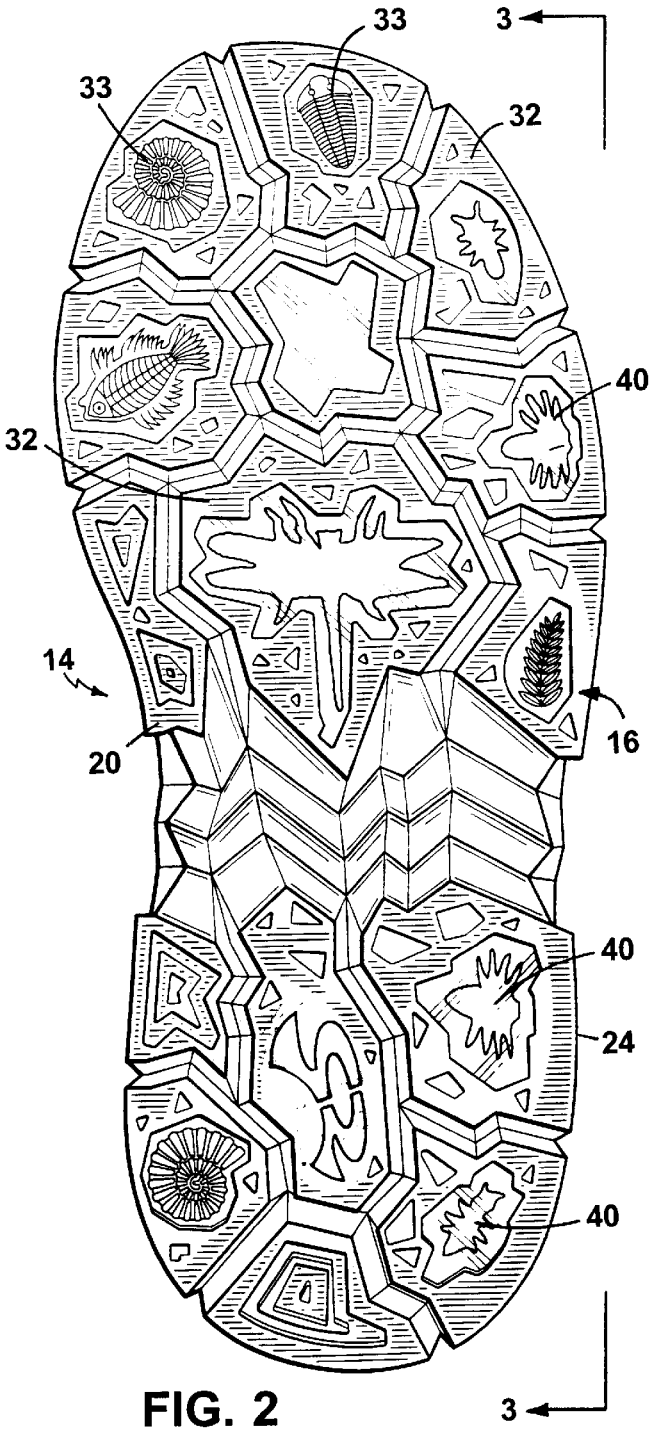
FIG. 2 is a bottom view showing the bottom surface of the outsole assembly of the shoe of FIG. 1.
Figure 5:
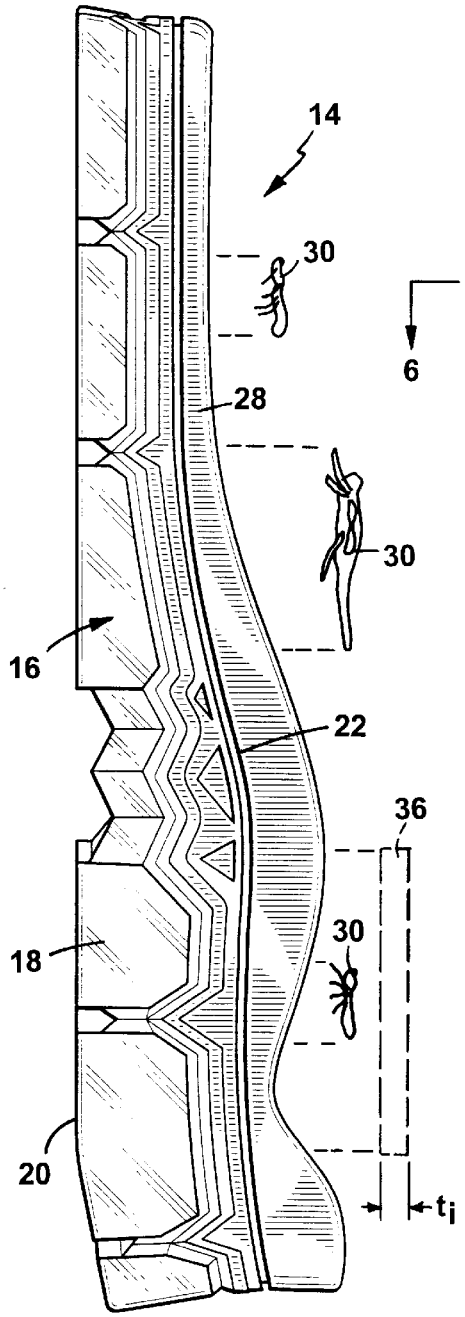
FIG. 5 is an exploded side view of the outsole assembly of the shoe of FIG. 4.
Figure 4:
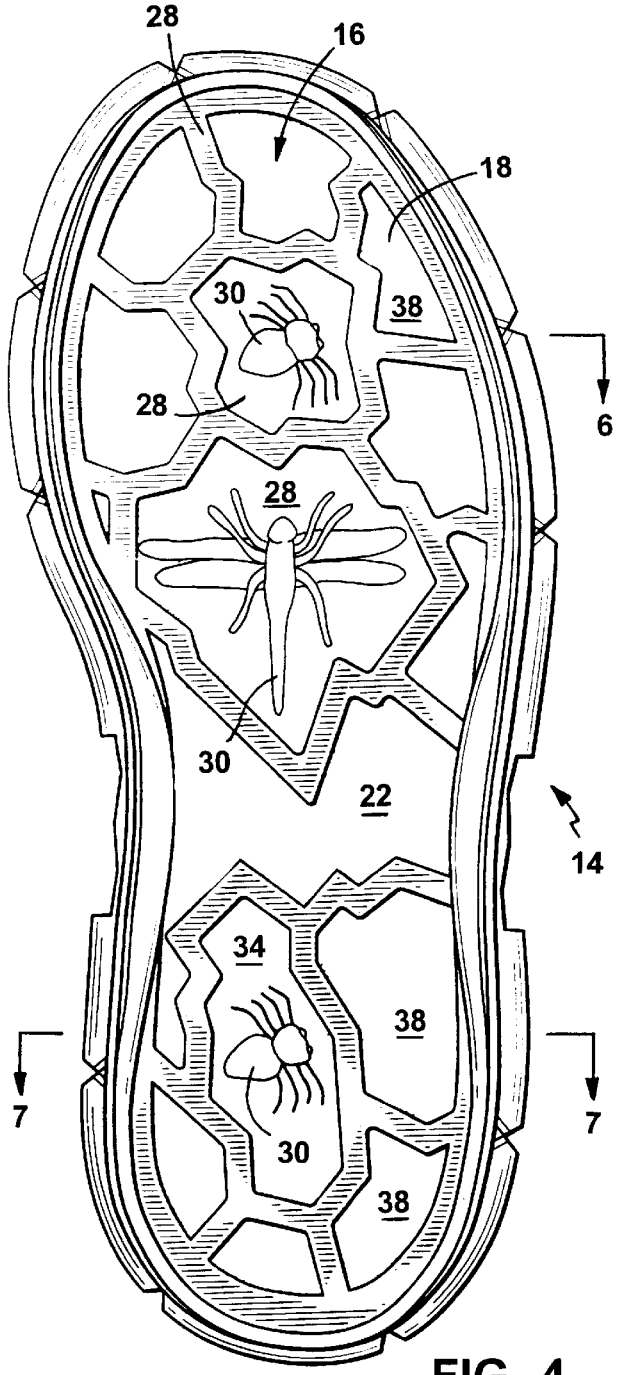
FIG. 4 is a top view of another embodiment of a (left) shoe showing the upper surface of an outsole assembly of the invention.

Referring to FIG. 1, a shoe 10 has an upper 12 defining a volume for enclosing a wearer's foot, and an outsole assembly 14 attached generally below the shoe upper.

Referring also to FIGS. 2–7, the outsole assembly 14 includes an outsole 16 with an outsole body 18 of a suitable, wear-resistant, transparent material, defining a water-impervious outsole bottom surface 20 disposed for engagement with a walking surface when worn, an outsole upper surface 22 disposed generally in opposition to the shoe volume defined by the upper 12, and an outsole side surface 24 extending peripherally about the outsole, generally between the outsole bottom and top surfaces 20, 22. A grid member 26 (which may be a separate element, as shown, or which may be formed integrally with the outsole body, e.g. by molding) defines a plurality of apertures 28 at the outsole upper surface 22.

Articles 30 are disposed within one or more of the apertures 28, with the articles disposed at the outsole upper surface 22 being observable at the outsole bottom surface 20 through the outsole body 18 of transparent material. In a preferred embodiment, the transparent material of the outsole body 18 resembles amber and the articles 30 are three dimensional representations of insects, e.g. prehistoric insects, preserved therein.

Preferably, the bottom surface 20 defines a plurality of lugs 32 (e.g. embossed with three dimensional representations 33 of fossils that imprint on soft walking surfaces, or when a wet shoe sole is walked upon a dry surface), and apertures 28 at the outsole upper surface 22 are disposed generally in registration with lugs 32.

Preferably, the articles 30 are sized in planar dimensions (i.e., length and width dimensions in an article plane, $P_A$, generally parallel to a plane, $P_o$, of the outsole upper surface 22) selected relative to planar dimensions of the corresponding aperture 28 to facilitate movement of the article 30 within the aperture 28 along the article plane, $P_A$, e.g. during walking or other movement of the wearer's feet.

The article 30 may also be sized in thickness dimensions (i.e. perpendicular to the article plane, $P_A$) to restrict movement, e.g. flipping, of the article 30 within the aperture 28. In this regard, referring to FIG. 7, in the heel region, where a heel or rear aperture 34 has a relatively greater height dimension in the direction of article thickness, an insert element 36 having a shape generally corresponding to the predetermined shape of the heel aperture and a predetermined insert thickness, $t_i$, is inserted into the heel aperture 34 containing an article in a manner to restrict movement of the article, e.g. in a direction perpendicular to the article plane $P_A$.

A method of the invention for assembly of footwear 10 includes the steps of providing an upper 12 and an outsole assembly 14, as described above, placing an article 30 into at least one aperture 28 defined at the upper surface 22 of the outsole body 18, and assembling the outsole assembly 14 with the upper 12 to form a shoe 10 having an article 30 that may be observed through the water-impervious bottom outsole surface 20. The method may include also the use of an insert 36 placed into an aperture 30, 30' of corresponding shape to restrict movement of an article 30 within the aperture.

Other embodiments are within the following claims. For example, apertures 38 may formed into the outsole body 18 in regions relatively close to the outsole side wall surface 24 so that articles 40 disposed therein may be observed through the outsole side wall surface 34, e.g. including even when the wearer is walking or standing.

What is claimed is:

1. A shoe comprising a shoe upper defining a volume for enclosing a wearer's foot, and an outsole assembly attached generally below said upper, said outsole assembly comprising an outsole comprising of an outsole body of transparent material defining a water-impervious outsole bottom surface disposed for engagement with a walking surface when worn, an outsole upper surface disposed generally in opposition to said volume, and an outsole side surface extending peripherally about said outsole generally between said outsole bottom surface and said outsole top surface, a grid member defining at least one aperture at said outsole upper surface, and at least one article disposed within said at least one aperture, said at least one article disposed in said at least one aperture at said outsole upper surface being observable through said water-impervious outsole bottom surface of said outsole body of transparent material.

2. The shoe of claim 1, wherein said grid member is integral with said outsole body.

3. The shoe of claim 1, wherein said grid member is disposed generally upon said outsole body in contact upon said outsole upper surface in said outsole assembly.

4. The shoe of claim 1, wherein said at least one article disposed within said at least one aperture comprises a three dimensional article.

5. The shoe of claim 4, wherein said three dimensional article has a form resembling an insect.

6. The shoe of claim 4 or 5, wherein said three dimensional article has a form resembling a fossil.

7. The shoe of claim 1, wherein said outsole body has a tint resembling amber, and said article resembles an insect preserved therein.

8. The shoe of claim 1, wherein said outsole bottom surface defines a plurality of lugs, and said at least one aperture defined at said outsole upper surfaces lies generally in register with a said lug.

9. The shoe of claim 1, wherein said three dimensional article has article planar dimensions in an article plane generally parallel to a plane of said outsole upper surface, said article planar dimensions being selected relative to planar dimensions of said at least one aperture in said article plane to facilitate movement along said article plane of said three dimensional article within said at least one aperture.

10. The shoe of claim 1 or 9, wherein said three dimensional article has article thickness dimensions in a direction generally perpendicular to said article plane, said article thickness dimensions being selected relative to thickness dimensions of said at least one aperture in a direction generally perpendicular to said article plane to restrict movement in a direction generally perpendicular to said article plane of said three dimensional article in said at least one aperture.

11. The shoe of claim 1, wherein said at least one aperture comprises a rear aperture disposed in a heel region of said outsole and having a predetermined shape at said outsole upper surface, and said outsole assembly further comprises an insert element having a shape generally corresponding to the predetermined shape of said rear aperture and a predetermined insert thickness, said insert element adapted to be received into said rear aperture containing a said three dimensional article in a manner to restrict movement of said three dimensional article in said rear aperture in a direction perpendicular to said article plane.

12. A method for assembly of footwear comprising the steps of:

providing a shoe upper defining a volume for enclosing a wearer's foot, providing an outsole assembly comprising an outsole comprising of an outsole body of transparent material defining a water impervious outsole bottom surface disposed for engagement with a walking surface when worn, an outsole upper surface disposed generally in opposition to said volume, and an outsole side surface extending peripherally about said outsole generally between said outsole bottom surface and said outsole top surface, and a grid member defining at least one aperture at said outsole upper surface, placing an article into said at least one aperture, and assembling the outsole assembly with the upper to form a shoe having an article that may be observed through the water-impervious bottom sole surface of the transparent outsole body.

13. The method of claim 12 comprising the further step of:

placing within said at least one aperture a three dimensional article having a form resembling an insect.

14. The method of claim 12 comprising the further step of:

placing within said at least one aperture a three dimensional article having a form resembling a fossil.

15. The method of claim 12 comprising the further steps of:

providing an outsole having a tint resembling amber, and placing within said at least one aperture a three dimensional article having a form resembling an insect or fossil.

16. The method of claim 12 comprising the further steps of:

providing an insert element having a shape generally corresponding to a predetermined shape of a rear aperture and a predetermined insert thickness, and, after placing an article into said rear aperture, inserting the insert element into said rear aperture.

* * * * *